US011299363B2

(12) United States Patent
Beale et al.

(10) Patent No.: US 11,299,363 B2
(45) Date of Patent: Apr. 12, 2022

(54) PRINT MEDIA ALIGNMENTS

(71) Applicant: Hewlett-Packard Development Company, L.P., Spring, TX (US)

(72) Inventors: Robert Scott Beale, Vancouver, WA (US); Elliott Downing, Vancouver, WA (US); Robert Yraceburu, Vancouver, WA (US); Bruce Johnson, Vancouver, WA (US); Cristopher Royce Jansson, Vancouver, WA (US); Stuart Scofield, Vancouver, WA (US); Francisco Javier Gomez, Vancouver, WA (US); Jonathon Cha Spafford, Vancouver, WA (US); Catherine Elizabeth Gould, Vancouver, WA (US); Tom McCue, Vancouver, WA (US); Matthew Douglas Reier, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 104 days.

(21) Appl. No.: 16/645,056

(22) PCT Filed: Sep. 15, 2017

(86) PCT No.: PCT/US2017/051913

§ 371 (c)(1),
(2) Date: Mar. 6, 2020

(87) PCT Pub. No.: WO2019/055035

PCT Pub. Date: Mar. 21, 2019

(65) Prior Publication Data

US 2021/0163251 A1 Jun. 3, 2021

(51) Int. Cl.

| | |
|---|---|
| ***B65H 31/32*** | (2006.01) |
| ***B65H 31/26*** | (2006.01) |
| ***B41J 11/00*** | (2006.01) |
| ***B41J 13/10*** | (2006.01) |
| ***B65H 29/10*** | (2006.01) |
| ***B65H 29/34*** | (2006.01) |

(52) U.S. Cl.
CPC ..... *B65H 31/32* (2013.01); *B41J 11/0045* (2013.01); *B41J 13/106* (2013.01);
(Continued)

(58) Field of Classification Search
CPC ..... B65H 31/32; B65H 31/26; B65H 29/34; B65H 29/26; B65H 29/10;
(Continued)

(56) References Cited

U.S. PATENT DOCUMENTS 6,042,106 A 3/2000 Kelly
6,311,971 B1 11/2001 Greer et al.
(Continued)

FOREIGN PATENT DOCUMENTS

JP 10194555 A * 7/1998
WO WO-2017099741 A1 6/2017
(Continued)

*Primary Examiner* — Luis A Gonzalez
(74) *Attorney, Agent, or Firm* — Brooks Cameron & Huebsch PLLC

(57) ABSTRACT

Example implementations relate to print media stacks. In some examples, a device may include a sheet channel to guide a sheet of print media within the sheet channel above and separated in a vertical direction from a stack of printed media when the sheet of print media exits a print path of a printer. The device may include a plurality of clamps to control alignment of the sheet of print media on the stack of printed media when the sheet channel moves outboard from the sheet of print media to allow the sheet of print media to fall onto the stack of printed media, wherein the plurality of clamps sequentially pin the sheet of print media to the stack of printed media from a middle portion of the sheet of print media outward.

16 Claims, 10 Drawing Sheets

(52) U.S. Cl.
CPC ..... *B65H 29/10* (2013.01); *B65H 29/34* (2013.01); *B65H 31/26* (2013.01); *B65H 2301/331* (2013.01)

(58) Field of Classification Search
CPC ..... B65H 2301/331; B65H 31/3018; B41J 13/106; B41J 11/0045
See application file for complete search history.

(56) References Cited

U.S. PATENT DOCUMENTS

| | | | | |
|---|---|---|---|---|
| 6,705,786 | B2 | 3/2004 | Trovinger | |
| 6,819,906 | B1 | 11/2004 | Herrmann et al. | |
| 6,843,476 | B2 | 1/2005 | Schuller et al. | |
| 7,431,288 | B2 | 10/2008 | Shmaiser et al. | |
| 10,822,191 | B2 * | 11/2020 | Johnson | B65H 29/12 |
| 10,894,683 | B2 * | 1/2021 | Rasmussen | B65H 31/26 |
| 10,961,073 | B2 * | 3/2021 | Rasmussen | B65H 31/20 |
| 2003/0194253 | A1 | 10/2003 | Trovinger | |
| 2015/0166277 | A1 | 6/2015 | Shelhart | |
| 2016/0090262 | A1 | 3/2016 | Wakayama et al. | |

FOREIGN PATENT DOCUMENTS

| | | |
|---|---|---|
| WO | WO-2017099742 | 6/2017 |
| WO | WO-2018048430 A1 | 3/2018 |
| WO | WO-2019054985 | 3/2019 |

* cited by examiner

PRINT MEDIA ALIGNMENTS

BACKGROUND

A printing device may print text and/or images on a sheet of print media. The printing device may include a print finisher. A print finisher may handle post-printing actions. For example, a print finisher may handle transporting, stacking, aligning, collating, and/or stapling of printed sheets of print media.

DETAILED DESCRIPTION

Figure 1:
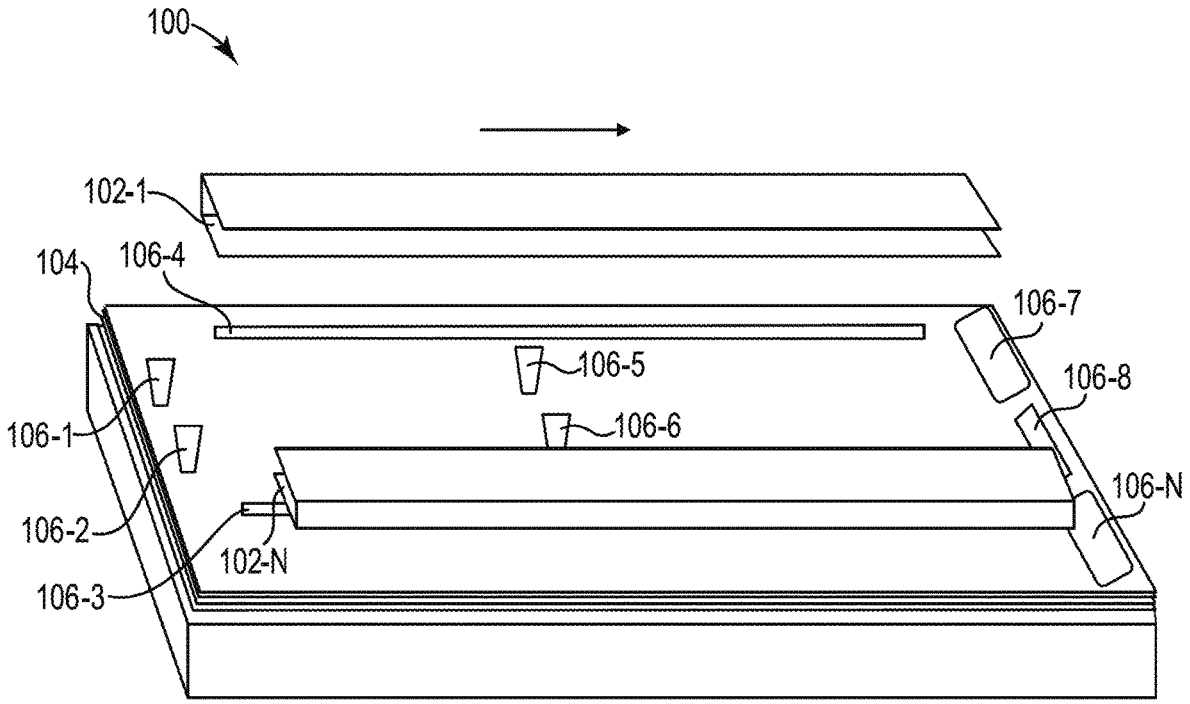
FIG. 1 is an example of a device consistent with the present disclosure.

Printing devices, such as printers, may allow text and/or images from a computing device to be printed onto a sheet of print media, such as paper. A printing device may include a print finisher. A print finisher may include mechanisms to process printed sheets of print media following the printing process.

Processing printed sheets of print media may include transporting, stacking, aligning, collating, stapling, etc. the printed sheets. The print finisher may utilize various mechanisms to process the printed sheets. For example, the print finisher may utilize various mechanisms to control the printed sheets throughout the post-print processing. The type of mechanism and/or sequence of utilizing the mechanisms may be influenced by the type of printing device being utilized.

For example, an ink jet printing device may recreate digital images specified by a computing device through propelling droplets of printing fluid (e.g., ink) onto a print media. In other words, an ink jet printing device may print a job by coating print media with printing fluid. Coating print media with printing fluid may alter the properties of the print media. For example, the physical properties of the print media may be altered by the moistening action of the printing fluid penetrating through and/or adhering to a surface of the print media.

For example, fibers such as paper fibers of a sheet of print media may swell or otherwise distort when they come in contact with the printing fluid and subsequently undergo drying of the printing fluid onto the print media. In an example, the sheet of print media may, as a result of the fiber-level distortion, may exhibit cockling (e.g., wrinkling of the surface of the sheet), waviness of the surface, curling at the edges, middle, or corners of the print media, etc. A sheet of print media may also exhibit reduced stiffness overall from the increased moisture content. Reduced stiffness of the sheet of print media may contribute to or worsen the cockling, waviness, and edge, middle, or corner curl. Additionally, high printing fluid density may increase the roughness of a surface of the sheet of print media, resulting in increased sheet-to-sheet friction. Moreover, the increased friction may render a process of shaking and/or vibrating a stack of sheets of print media to align the edges of each sheet ineffective.

The above described examples of alterations to the physical properties of the print media that may influence and/or complicate the post-printing processing of the print media. To address the alterations of the physical properties, a higher paperweight of print media that is more resistant to the alterations may be utilized. Higher weight print media may be more expensive and less appropriately suited to an end application. To address the alterations of the physical properties, a resin coated print media that is less absorbent may be utilized. Resin coated print media may be more expensive and may result in a less durable printed product. To address the alterations of the physical properties, a relatively reduced amount of printing fluid and/or a decreased printer resolution may be utilized. Reduced printing fluid amounts and/or lower resolution may result in less durable and less visually appealing printed products.

In some examples, rather than utilizing the above described modifications to the print media and/or printing process, print finishers associated with printing devices may constrain a printed sheet prior to stacking and/or stapling until the printed media and/or the printing fluid deposited on the printed media is fully dried. The above described constraining until dry method may add significant time and mechanical complexity to the printing and/or post-print processing processes. For example, the next sheet of print media in a print job to be printed may be delayed in order to accommodate for the dry time of the most recently printed sheet of print media. In another example, additional mechanical apparatuses and/or run length of existing mechanical apparatuses may be implemented in order to keep the most recently printed sheet constrained until fully dried.

In contrast, processing print media according to the present disclosure may utilize a print finisher and/or a print finishing process that may control print media distortion and stack alignment of an incoming printed sheet of print media and printed sheets of print media previously accumulated on a stack. For example, processing print media according to the present disclosure may include controlling distortion such as cockling, edge curl, and corner curl of the incoming sheet as well as sheets on the stack. Processing print media according to the present disclosure may control and maintain x-axis and y-axis registration of the stack. Processing print media according to the present disclosure may utilize sheet channels and a plurality of clamps to control print media distortion and stack alignment during post-print processing.

FIG. 1 is an example of a device 100 for post-print processing consistent with the present disclosure. The device 100 may be implemented in a variety of imaging printing devices, such as printers or copiers, for example. In some examples, the device 100 may be implemented in a print finisher device for post-print processing of printed sheets of print media. A printed sheet of print media may not be fully dried and/or dry to the touch. That is, the printing fluid deposited on the sheet of print media may be partially dried and partially set to the surface of the sheet of print media. As such, the sheet of print media may be partially dried inkjet media. The sheet of print media may have a moisture content that is above a threshold amount associated with causing print media distortion.

The device 100 may include a sheet channel 102-1 . . . 102-N. The sheet channel 102-1 . . . 102-N may include opposing sheet channels 102-1 . . . 102-N. The sheet channel 102-1 . . . 102-N may extend longitudinally in the direction of transportation (shown as an arrow) of a sheet of print media that is entering the sheet channel 102-1 . . . 102-N as it exits a print path of a printer. For example, a printing device may deposit printing fluid onto the sheet of print media as the sheet of print media is transported through a print path within the body of the printing device. The sheet of print media may exit the print path of a printer immediately following passing under a print head that deposits the printing fluid. The sheet of print media may emerge from the print path and be ejected and/or transported in the direction of transportation immediately into the sheet channel 102-1 . . . 102-N. The sheet channel 102-1 . . . 102-N may be utilized for post-print processing such as stacking or stapling of the sheets of print media, but may not be utilized to transport the sheet of media for further printing.

The sheet channel 102-1 . . . 102-N may extend substantially the length of a sheet of print media and/or a stack of printed media 104. The stack of printed media 104 may be a stack of sheets of printed media that have previously been printed on, exited the printing path of the printer, were transported into the sheet channel 102-1 . . . 102-N, and where added to the stack through the below described sequence of clamping and sheet channel 102-1 . . . 102-N manipulation. In other examples, the sheet channel 102-1 . . . 102-N may be sized for any desired length, such as extending only the trailing half or trailing quarter of a sheet of print media and/or a stack of printed media 104, for example.

The sheet channel 102-1 . . . 102-N may include channel walls that define a channel sized to accommodate passage of a sheet of print media there through. As such, the channel may have a height and a width. The height may be a distance between a lower channel wall and an upper channel wall. The lower channel wall may be the portion of the sheet channel 102-1 . . . 102-N that supports a sheet of print media traversing the sheet channel 102-1 . . . 102-N and prevents the sheet of print media from falling from the effects of gravity. The upper channel wall may be opposing the lower channel wall and may physically restrict a sheet of print media that is traversing the sheet channel 102-1 . . . 102-N from rising above the sheet channel 102-1 . . . 102-N. The height may be a height to accommodate a single sheet of print media. The width of the channel may be a distance between the edge of the lower channel wall or the upper channel wall and a back wall connecting the opposing edges of the lower channel wall and the upper channel wall. The width may be a width long enough to accommodate a portion of a longitudinal edge portion of a bottom face of the sheet of print media such that the sheet of print media is prevented from falling below the sheet channel 102-1 . . . 102-N while the sheet channel 102-1 . . . 102-N is maintained in a first position. The width may be a width short enough to accommodate the action of the plurality of clamps 106-1 . . . 106-N in the clamping sequence described below.

The sheet channel 102-1 . . . 102-N may be moveable within a body of the print finisher 100. The sheet channel 102-1 . . . 102-N may move vertically up or down. For example, the sheet channel 102-1 . . . 102-N may move vertically down away from the plane of a print path and toward the stack of printed media 104. For example, the sheet channel 102-1 . . . 102-N may move vertically down so that it rests on and/or applies pressure to a top face of a top sheet of printed media in the stack of printed media 104. The sheet channel 102-1 . . . 102-N may move vertically up away from the plane of the print path toward a top of a print finisher device 100. The sheet channel 102-1 . . . 102-N may move vertically up or down to move the sheet channel 102-1 . . . 102-N into alignment with the plane of the print path to accept a sheet of print media exiting the print path.

The sheet channel 102-1 . . . 102-N may be moveable horizontally inboard or outboard. For example, opposing sheet channels 102-1 . . . 102-N may be moved outboard by moving the sheet channels away from each other and/or away from a center point between the opposing sheet channels 102-1 . . . 102-N. Moving parallel opposing sheet channels 102-1 . . . 102-N outboard when a sheet of print media is located within the opposing sheet channels 102-1 . . . 102-N may remove the support provided from the opposing sheet channels 102-1 . . . 102-N to the sheet of print media resulting in the sheet of print media falling below the opposing sheet channels 102-1 . . . 102-N. In an example, moving parallel opposing sheet channels 102-1 . . . 102-N outboard when a sheet of print media is located within the opposing sheet channels 102-1 . . . 102-N may cause the sheet of print media to fall onto the stack of printed media 104 below. The opposing sheet channels 102-1 . . . 102-N may be moved inboard by moving the sheet channels toward each other and/or toward a center point between the opposing sheet channels 102-1 . . . 102-N.

The sheet channel 102-1 . . . 102-N may be located above the stack of printed media 104. The sheet channel 102-1 . . . 102-N may be vertically separated from the stack of printed media 104. As such, the sheet channel 102-1 . . . 102-N may guide the sheet of print media as the sheet exits a print path of a printer keeping the sheet of printed media above and separated in a vertical direction from the stack of printed media 104. As such, when a sheet of print media exits a print path of a printer and is pulled into a sheet channel 102-1 . . . 102-N above the stack of printed media 104, the sheet of print media may traverse the stack of printed media 104 without dragging across the surface of the top sheet of printed media in the stack of printed media 104.

As described above, recently printed and not fully dried print media may undergo various distortions than increase sheet-to-sheet friction and can lead to a jam in the device 100 and/or a misalignment between a sheet of print media being added to the stack of print media 104 and the stack of print media 104. Utilizing the sheet channel 102-1 . . . 102-N may allow the sheet of print media being added to the stack to traverse the longitudinal length of the stack of print media 104 without sheet-to-sheet contact between a leading edge of the sheet of print media and a top sheet of print media in the stack of printed media 104. Therefore, utilizing the sheet channel 102-1 . . . 102-N may allow a device 100 to perform post-printing processing on a sheet of print media that has a relatively higher moisture content with fewer errors than devices 100 that rely on sheet-to-sheet contact in placing an incoming sheet of print media on a stack of printed media 104.

The device 100 may include a plurality of clamps 106-1 . . . 106-N. The plurality of clamps 106-1 . . . 106-N may include clamping mechanisms to pin, squeeze, hold, and/or otherwise guide and/or preserve the alignment of an incoming sheet of print media with a stack of printed media 104 that the incoming sheet is being added to. In an example, the plurality of claims 106-1 . . . 106-N may be open, closed, and/or otherwise actuated to control and/or maintain an alignment of the incoming sheet of print media with the stack of printed media 104. For example, the plurality of clamps 106-1 . . . 106-N may be sequentially actuated to pin the incoming sheet of print media to the stack of printed media 104. The plurality of clamps 106-1 . . . 106-N may be sequentially actuated during and/or immediately following the sheet channel 102-1 . . . 102-N moving outboard and allowing the sheet of print media to fall onto the stack of printed media 104.

In some examples, the plurality of clamps 106-1 . . . 106-N may sequentially pin the sheet of print media to the stack of printed media 104 in a middle-out sequence. Sequentially pin the sheet of print media to the stack of printed media 104 in a middle-out sequence may include first actuating and/or closing a middle page clamp (e.g., 106-5 and 106-5) of the plurality of clamps 106-1 . . . 106-N to pin the incoming sheet to the stack of printed media 104 before actuating peripherally located clamps of the plurality of claims 106-1 . . . 106-N at the leading edge, trailing edge, and/or longitudinal edges of the sheet of media. In some examples, the plurality of clamps 106-1 . . . 106-N may be actuated to sequentially pin the sheet of print media to the stack of printed media 104 starting at a middle portion of the upper face of the sheet of print media by closing the middle page clamps. However, dependent on the size or feeding orientation of the print media, the middle page clamps may not, when closed, pin the middle portion of the upper face of the sheet of print media to the printed media stack 104.

In addition to a middle page clamp (e.g., 106-5 and 106-6) the plurality of clamps 106-1 . . . 106-N may include a leading edge clamp (e.g., 106-8), a corner clamp (e.g., 106-7 and 106-N), an edge clamp (e.g., 106-3 and 106-4), and/or a trailing edge clamp (e.g., (106-1 and 106-2). The middle page clamp may apply its clamping force substantially in between where the trailing edge clamp applies its clamping force and where the leading edge clamp applies its clamping force. The middle page clamp may apply its clamping force substantially in between where two opposing edge clamps apply their clamping force. The middle page clamp may be located in the device 100 such that it applies its clamping force substantially in the longitudinal middle of a mezzanine upon which the stack of printed media 104 rests and or to a portion of the upper face of a sheet of printed media substantially in the middle of the two longitudinal edges of the sheet of printed media on top of the printed media stack 104. For example, the middle page clamp may include a clamp surface that makes contact with an approximate middle (lengthwise and/or widthwise) of an upper surface of a sheet of print media being placed or having been placed on the stack of printed media 104. As such, the middle page clamp may pin a middle portion of a sheet of print media to the stack of printed media 104.

The leading edge clamp may be located in the device 100 such that the leading edge clamp applies its clamping force at a portion of a leading edge of a sheet of print media on top of the printed media stack 104. The leading edge clamp may be located in the device 100 such that it applies its clamping force at a portion of a leading edge between a portion of the leading edge where two corner clamps apply their clamping force to a sheet of print media on top of the printed media stack 104. For example, the leading edge clamp may include a clamping surface that makes contact with an approximate widthwise middle of an upper surface of a sheet of printed media at its leading edge while the sheet is being placed on or is resting on the stack of printed media 104. As such, the leading edge clamp may pin a leading edge portion of a sheet of print media to the stack of printed media 104.

The corner clamps may be located in the device 100 such that the corner clamps apply their clamping force at the corner portions of a sheet of printed media on top of the stack of printed media 104. A corner portion may include a portion of a leading edge and a portion of a longitudinal edge of a sheet of print media on top of the stack of printed media 104. The corner clamps may be located outboard of the leading edge clamps. In some examples, the corner clamps may be mechanically linked to a portion of the leading edge clamp and/or an actuator of the leading edge clamp. In such examples, actuating a clamping action of the leading edge clamp to pin the leading edge of the sheet of print media to the stack of printed media 104 may drive the clamping and/or pinning action of the corner clamps. In other examples, the corner clamps may be actuated and/or driven by a servomechanism separate from an actuating and/or driving mechanisms of the leading edge clamp, such that the leading edge clamp and the corner clamps may be actuated independently from one another. The corner clamps may each include a clamping surface that makes contact with an approximate leading edge corner of an upper surface of a sheet of printed media while the sheet is being placed on or is resting on the stack of printed media 104. As such, the corner clamp may pin a corner portion of a sheet of print media to the stack of printed media 104.

The edge clamps may be located in the device 100 such that the edge clamps apply their clamping force along a length of a respective longitudinal edge portion of a sheet of printed media on top of the stack of printed media 104. An edge clamp may be located in the device 100 such that the edge clamp includes a clamping surface that makes contact with a portion of a longitudinal edge of an upper surface of a sheet of print media on a stack of printed media 104. The portion of the longitudinal edge that the clamping surface is contacting may be located in between the portion of the upper surface of the sheet of print media contacted by the corner clamp and the trailing edge clamp. As such, the edge clamp may pin an edge portion of a sheet of print media to the stack of printed media 104.

The trailing edge clamp may be located in the device 100 such that the trailing edge clamp applies its clamping force at a trailing edge portion of a sheet of print media on top of the stack of printed media 104. The trailing edge clamp may be located in the device 100 such that the trailing edge clamp includes a clamping surface that makes contact with a portion of a trailing edge of an upper surface of a sheet of print media on a stack of printed media 104. As such, the trailing edge clamp may pin a trailing edge portion of a sheet of print media to the stack of printed media 104.

Figure 2:
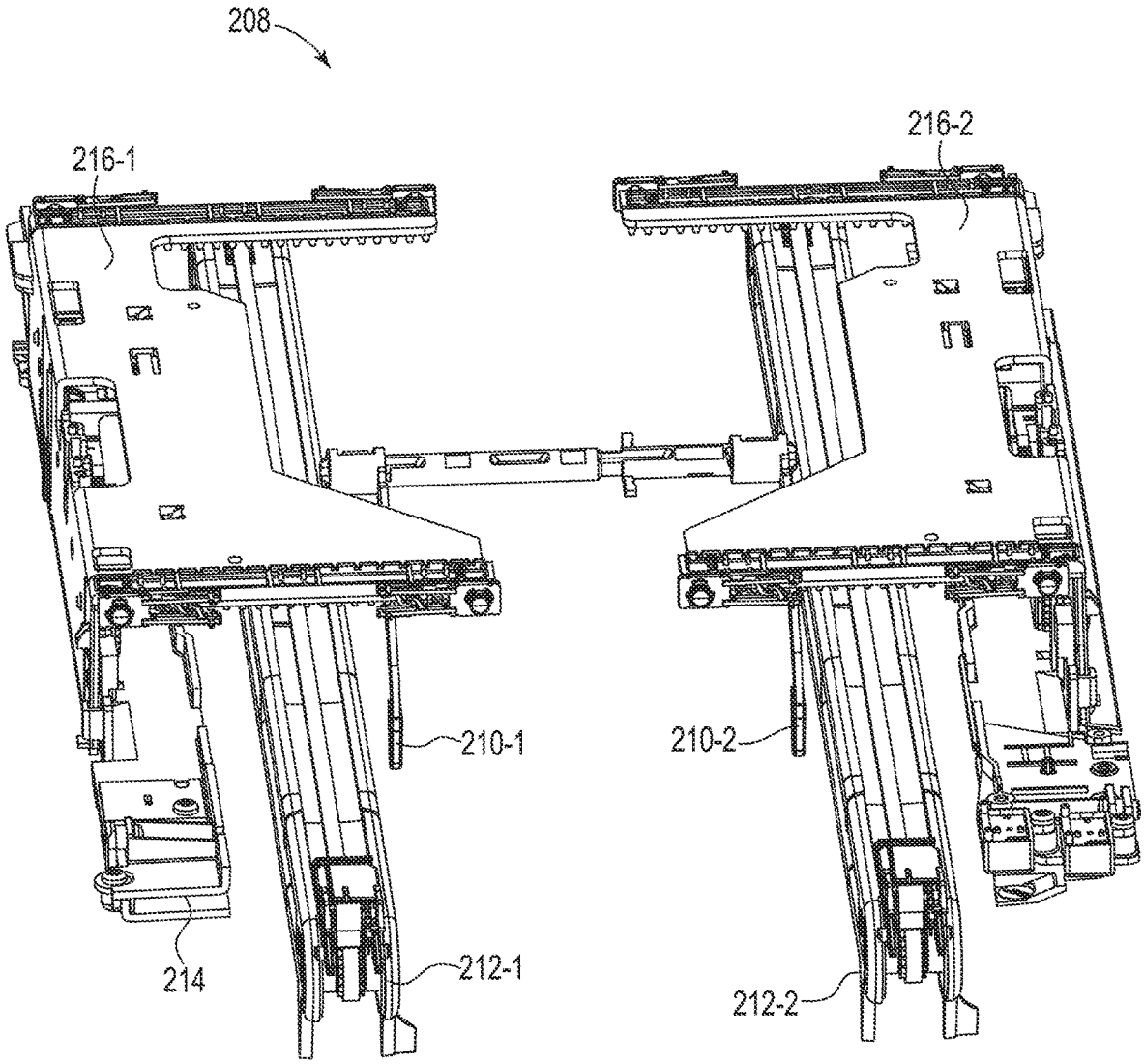
FIG. 2 is another example of a device consistent with the present disclosure.

FIG. 2 is an example of a portion of a device 208 for post-print processing consistent with the present disclosure. The portion of the device 208 may be a top plate subassembly of a print finisher. The portion of the device 208 may include channel translators 216-1 . . . 216-2. The channel translators 216-1 . . . 216-2 may include a moveable frame. The frame may include and/or be attached to components that may be moved along with the movement of the channel translators 216-1 . . . 216-2. For example, the channel translators 216-1 . . . 216-2 may include a sheet channel 214. The sheet channel 214 may be moved with the movements of the channel translators 216-1 . . . 216-2. The channel translators 216-1 . . . 216-2 may be moveable vertically up, vertically down, horizontally inboard, and/or horizontally outboard. In some examples, the channel translators 216-1 . . . 216-2 may be movable horizontally inboard, and/or horizontally outboard, while the sheet channel 214 may be moveable vertically up and/or vertically down on the channel translators 216-1 . . . 216-2. The sheet channel 214 may be structurally and/or functionally similar or identical to the sheet channel 102.1 . . . 120-N discussed in FIG. 1. The sheet channel 214 may guide and support a sheet of print media exiting a print path of a printer.

The channel translators 216-1 . . . 216-2 and the attached sheet channel 214 may be moved to perform an x-axis registration of an incoming sheet of print media. Since the incoming sheet of print media is transported within the sheet channel 214, adjusting the position of the channel translators 216-1 . . . 216-2 relative to a stack of printed media may adjust the alignment of the incoming sheet of print media relative to the stack of printed media below the sheet channel 214. As such, an x-registration may include adjusting the position of the sheet channel 214 and the incoming sheet of print media within the sheet channel 214 such that the two longitudinal edges of the incoming sheet of print media are aligned with the longitudinal edges of the sheets of print media in the stack of printed media below the sheet channel 214.

The portion of the device 208 may include clamping mechanisms. For example, the portion of the device 208 may include middle page clamps 210-1 . . . 210-2. The middle page clamps 210-1 . . . 210-2 may be structurally and/or functionally similar or identical to the middle page clamp 106-5 and 106-6 discussed in FIG. 1.

The portion of the device 208 may include puller assemblies 212-1 . . . 212-2. The puller assemblies 212-1 . . . 212-2 may include an advancement mechanism for advancing a sheet of print media from the print path of the printer through the sheet channel 214 over and vertically separated from a stack of printed media. The puller assemblies 212-1 . . . 212-2 may include a puller clamp that engages a leading edge of a sheet of print media exiting a print path of a printer. The puller assemblies 212-1 . . . 212-2 may include a conveyor belt that conveys the puller clamp longitudinally along the puller assembly and transports the sheet of print media through the sheet channel by pulling on it with the puller clamp.

The puller assembly 212-1 . . . 212-2 may include stripping fangs and a y-axis registration surface. The stripping fangs may include a set of parallel bars spaced apart approximately the width of the puller clamp. The puller clamp may pass through the space between the fangs as it travels along the puller assembly 212-1 . . . 212-2. As it passes through the space between the fangs the leading edge of the sheet of paper may contact the fangs and/or the y-axis registration surface and be stripped from the puller clamp and allowed to fall free.

The y-axis registration surface may include a flat surface that contacts the leading edge of the incoming sheet of print media and aligns the leading edge of the incoming sheet of print media with the leading edge of printed sheets in a stack below the sheet channel 214. That is, the y-axis registration may result in the leading edge and the trailing edge of the incoming sheet of print media being aligned with the leading edge and the trailing edge of the printed sheets in the stack below the sheet channel 214 as the incoming sheet is added to the stack.

Figure 3:
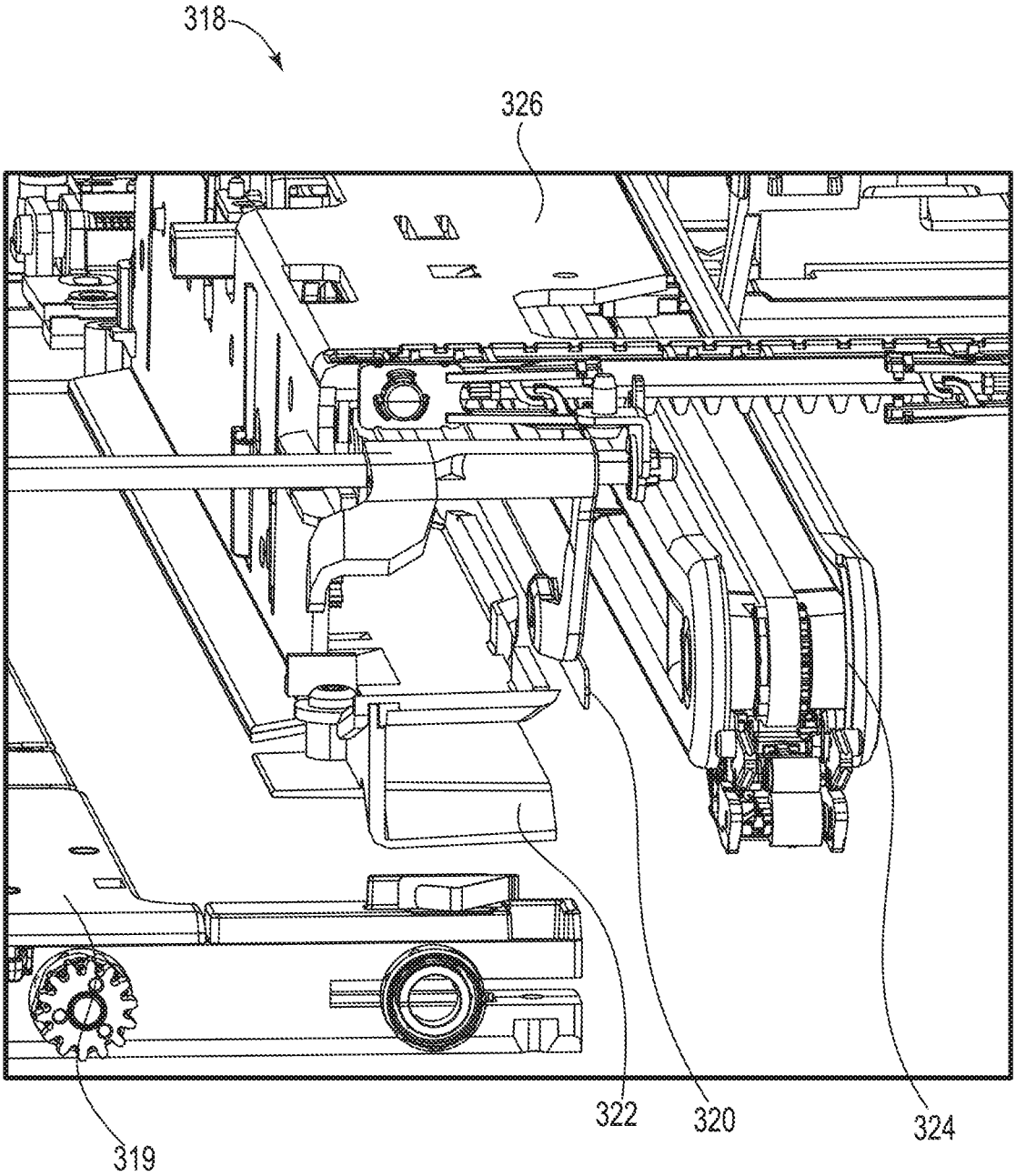
FIG. 3 is another example of a device consistent with the present disclosure.

FIG. 3 is an example of a portion of a device 318 for post-print processing consistent with the present disclosure. The portion of the device 318 may be a portion of a print finisher. The portion of the device 318 may include a channel translator 326.

A sheet channel 322 may be attached to the channel translator 326. In an example, a print finisher may include a plurality of sheet channels that may be moved closer together and/or further apart by movements of the channel translator 326. As such, a plurality of sheet channels may be moved by the channel translator 326 to different distances relative to one another to accommodate different sizes of sheets of print media within the plurality of sheet channels.

The portion of the device 318 may include an edge clamp 320. The edge clamp 320 may be moveable vertically up or down to apply clamping force to a longitudinal edge of a sheet of print media on a stack of printed media supported by a mezzanine 319 located below the sheet channel 322. The edge clamp 320 may be located between a puller assembly 324 and a sheet channel 322. The edge clamp 320 may be connected to the channel translator 326. Additionally, movement of the channel translator 326 may move the edge clamp 320. The position of the edge clamp 320 relative to a sheet of print media on a stack of printed media may be changed via the movement of the channel translator 326. In other examples, the position of the edge clamp 320 could be controlled by a separate servomechanical system. As such, the position of the edge clamp 320 may be changed to accommodate different sizes (e.g., widths) of print media.

The portion of the device 318 may include a mezzanine 319 located below the channel translator 326. The mezzanine 319 may be a portion of the device 318 that supports a stack of printed media. The mezzanine 319 may include a substantially flat surface or plurality of surfaces where a stack of printed media is accumulated. The portion of the device 318 may also include a puller assembly 324.

Figure 4:
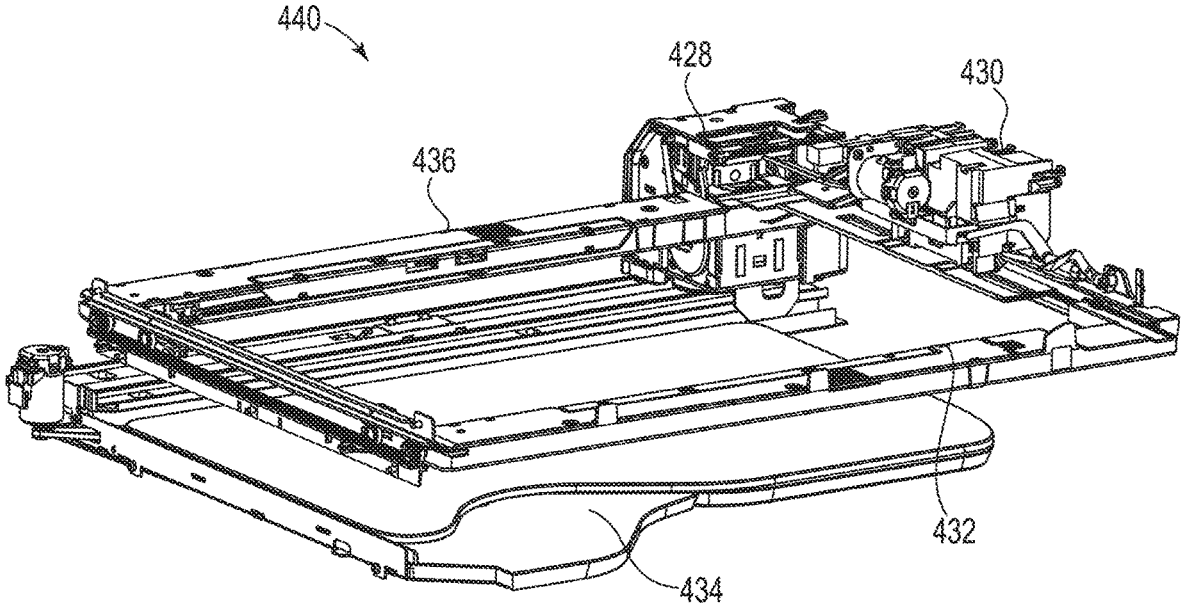
FIG. 4 is another example of a device consistent with the present disclosure.

FIG. 4 is an example of a portion of a device 440 for post-print processing consistent with the present disclosure. The portion of the device 440 may be a portion of a print finisher. The portion of the device 440 may include a mezzanine that supports a stack of printed media of a print job. The mezzanine may include a rear mezzanine 436 and a front mezzanine 432. The rear mezzanine 436 and front mezzanine 432 may include a platform that receives and supports sheets of print media after they are released from a sheet channel above the rear mezzanine 436 and front mezzanine 432. The rear mezzanine 436 and front mezzanine 432 may be moveable horizontally outboard and inboard. When the rear mezzanine 436 and front mezzanine 432 are supporting a stack of printed media and are moved outboard, the stack of printed media may be dropped into an output tray 434 for retrieval by a user.

The portion of the device 440 may include a stapling device 428. As used herein, a stapling device 428 refers to a device to receive a plurality of printed sheets of print media of a print job and join the pages together using a fastener, such as a staple. Having a stapling device 428 located on a finishing device may allow a complete finishing of a print job. For example, a stapling device 428 located on a finishing device may remove an additional step of fastening loose pages of a print job together upon completion of the print job.

In some examples, the stapling device 428 may be fixed. That is, the stapling device 428 may not move with respect to the other components of the portion of the device 440 and/or the print job. In other examples, the stapling device 428 may be moveable along a single axis and/or a plurality of axes. For example, the stapling device 428 may be moveable along a longitudinal axis parallel to a longitudinal edge of the sheet of print media. In the portion of the device 440 with a stapling device 428, the print job may be moved by the device 440 to a particular position. That is, a print job that is to be stapled may be moved into position to be stapled by the stapling device 428. Once the print job has been moved into position by the device 440, the stapling device 428 may fasten the print job. In some examples, the portion of the device 440 may include a lifting wing to incline, lift, and guide a stack of printed media into the stapling device 428.

The portion of the device 440 may include a leading edge clamp assembly 430. The leading edge clamp assembly 430 may be utilized to actuate the leading edge clamps and/or the corner clamps to clamp a sheet of print media to a stack of printed media.

Figure 5:
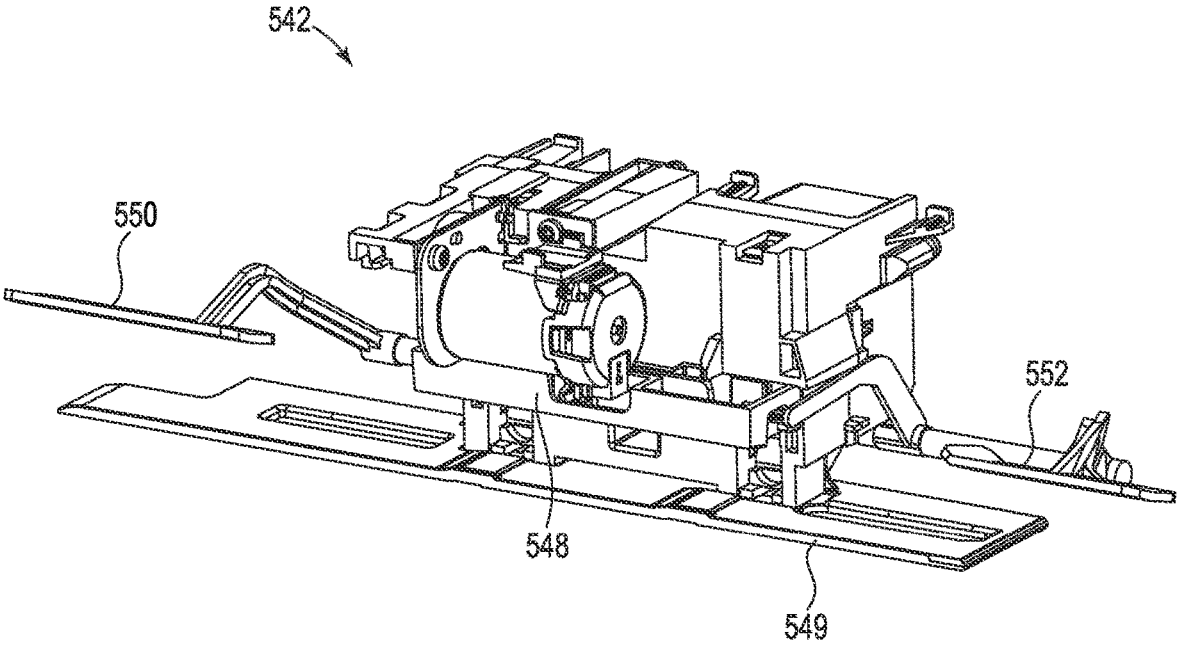
FIG. 5 is an example of a leading edge clamp assembly consistent with the present disclosure.

FIG. 5 is an example of a leading edge clamp assembly 542. The leading edge clamp assembly 542 may be a portion of a device for post-print processing consistent with the present disclosure. The leading edge clamp assembly 542 may include actuating mechanisms to close a leading clamp 548 against a leading edge of a print sheet generating clamping force by pinning the sheet between the leading edge clamp 548 and a shelf 549. The shelf 549 may be fixed and the leading edge clamp 548 may be moveable.

The leading edge clamp assembly 542 may include actuating mechanisms to close a plurality of corner clamps 550 and 552 against a corner portion at a leading edge of a print sheet by generating clamping force by pinning the sheet between the corner clamps 550 and 552 and a shelf 549. The shelf 549 may be fixed and the corner clamps 550 and 552 may be moveable. In the example, illustrated in FIG. 5, the corner clamps 550 and 552 are mechanically linked to the leading edge clamp 548 such that actuating the leading edge clamp 548 results in an actuation of the corner clamps 550 and 552.

Figure 6:
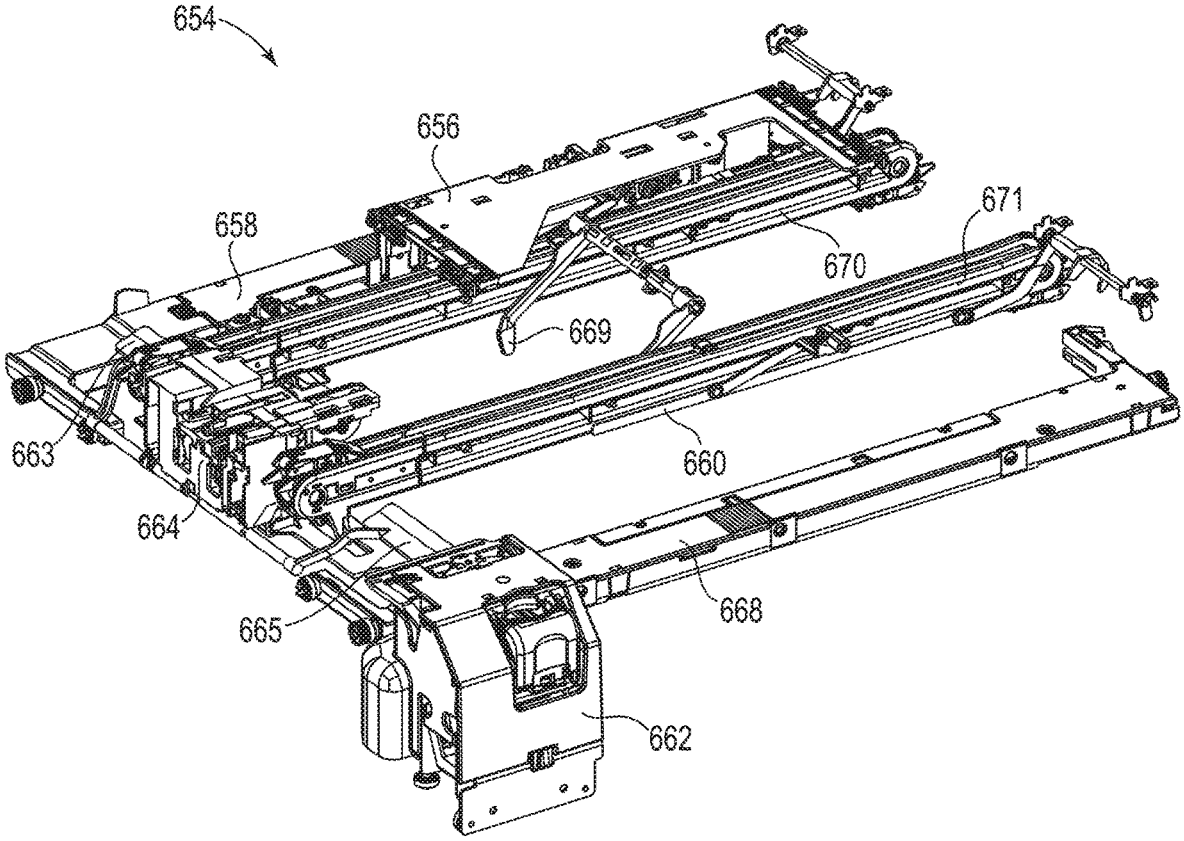
FIG. 6 is another example of a device consistent with the present disclosure.

FIG. 6 is an example of a portion of a device 654 for post-print processing consistent with the present disclosure. The portion of the device 654 may be a portion of a print finisher. The portion of the device 654 may include a channel translator 656. The portion of the device 654 may include a front mezzanine 658 and a rear mezzanine 668. The channel translator 656 may be located above the front mezzanine 658 and a rear mezzanine 668.

The portion of the device 654 may include a puller assembly 670 and 671 and an edge clamp assembly 660. The edge clamp assembly 660 may be positioned such that the clamping surface of the edge clamp assembly 660 drops down between the puller assembly 670 and 671 and a sheet channel attached to the channel translator 656 toward a stack of printed media supported by the front mezzanine 658 and rear mezzanine 668.

The portion of the device 654 may include a plurality of edge clamp assemblies. Edge clamp assembly 660 may be one of the plurality of edge clamp assemblies. The edge clamp assembly 660 may be a rear edge clamp assembly. The portion of the device 654 may include a front edge clamp assembly (not visible in FIG. 6). The front edge clamp assembly may drop down between the puller assembly 670 and a sheet channel attached to channel translator 656.

The portion of the device 654 may include a leading edge clamp assembly 664. The portion of the device 654 may include a plurality of corner clamps 663 and 665. The portion of the device 654 may include a middle page clamp 669.

The portion of the device 654 may include a stapling device 662. A stack of printed media resting on the front mezzanine 658 and rear mezzanine 668 may be shifted over into a mouth of the stapling device 662. The stapling device 662 may fix the stack together before the fixed stack is dropped into an output tray below the front mezzanine 658 and rear mezzanine 668.

Figure 7:
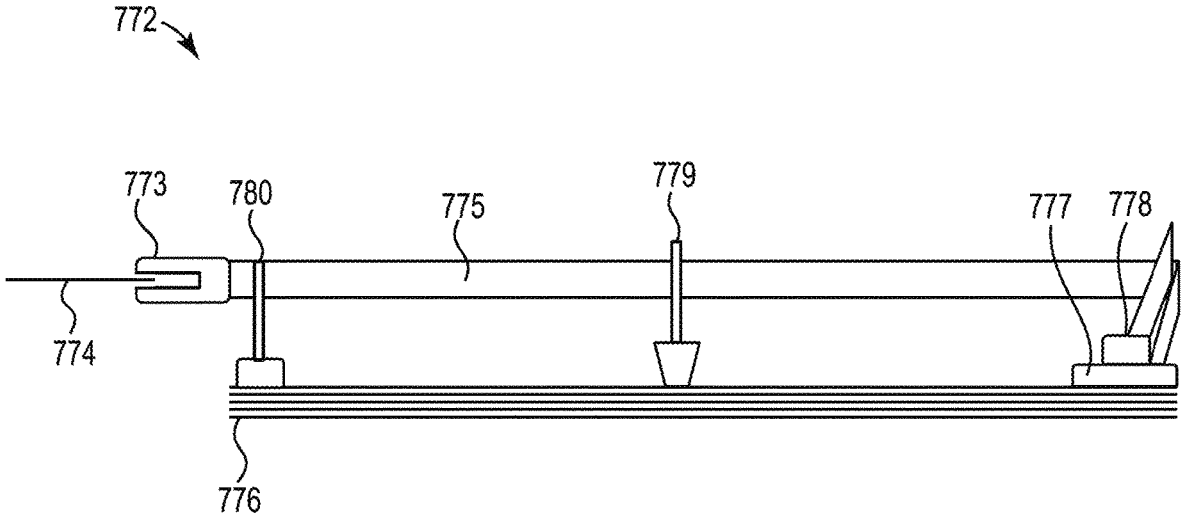
FIG. 7 is an example of a system consistent with the present disclosure.

FIG. 7 is an example of a system 772 for post-print processing consistent with the present disclosure. The system 772 may include a media puller 773 to pull a sheet of print media 774 within a sheet channel 775 positioned above and separated vertically from a stack of print media 776. The sheet of print media 774 and the stack of print media 776 may be prints from a same print job. That is, the sheet of print media 774 and the stack of print media 776 may be parts of the same print job.

The system 772 may include a mid-page clamp 779. The mid-page clamp 779 may be closable to pin a middle portion of the sheet of print media 774 to the stack of print media 776. The system 772 may also include a leading edge clamp 778 and a corner clamp 777 closable to pin the leading edge of the sheet of print media 774 and a corner portion of the sheet of print media 774 to the stack 776. The system 772 may also include a trailing edge clamp 780. The trailing edge clamp may be closable to pin a trailing edge of the sheet of media 774 to the stack 776.

FIG. 7 illustrates the sheet channel 775 aligned with the print path of the printer. The sheet of print media 774 is illustrated exiting the print path and being pulled by the puller 773 into the sheet channel 775. The leading edge clamp 778, the corner clamp 777, the mid-page clamp 779, and the trailing edge clamp 780 are illustrated closed. In the closed orientation the leading edge clamp 778, the corner clamp 777, the mid-page clamp 779, and the trailing edge clamp 780 are obstructing the path that the sheet of print media 774 will take through the sheet channel 775.

The trailing edge clamp 780 may be opened and moved out of the path of the sheet of print media 774 immediately prior to the leading edge of the sheet of print media 774 passing the position occupied by the trialing edge clamp 780. The mid-page clamp 779 may be opened and moved out of the path of the sheet of print media 774 subsequent to opening the trailing edge clamp 780 and immediately prior to the leading edge of the sheet of print media 774 passing the position occupied by the mid-page clamp 779.

The system 772 may include a sensor in the sheet channel 775. Once the sensor detects the leading edge of the sheet of print media 774 at a position in the sheet channel 775, the puller 773 may momentarily pause its travel in the longitudinal direction. During the pause, an x-axis registration of the sheet of print media 774 may be performed by shifting the sheet channel 775 guiding the sheet of print media 774 to align the longitudinal edges with the longitudinal edges with the sheets in the stack 776. The x-axis registration may also be performed by moving the puller 773 clamping the sheet of print media 774 to align the longitudinal edges with the longitudinal edges with the sheets in the stack 776.

The leading edge clamp 778 and the corner clamp 777 may be opened and moved out of the path of the sheet of print media 774 immediately subsequent to or during the X-axis registration. The leading edge clamp 778 and the corner clamp 777 may be opened and moved out of the path of the sheet of print media 774 prior to the to the leading edge of the sheet of print media 774 passing the position occupied by the mid-page clamp 779 leading edge clamp 778 and the corner clamp 777.

Figure 8:
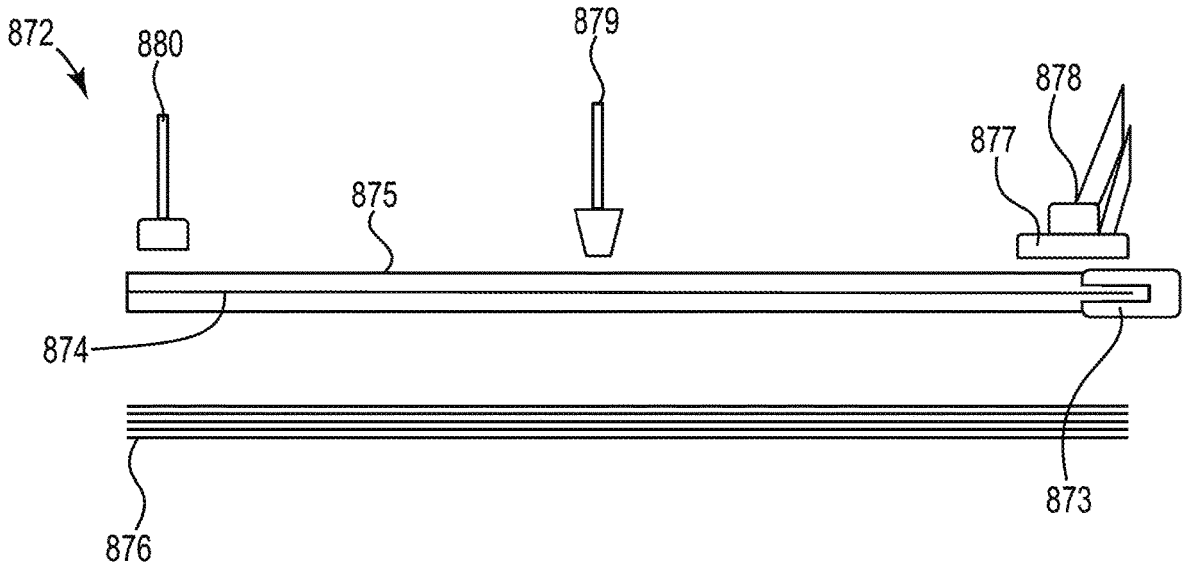
FIG. 8 is another example of a system consistent with the present disclosure.

FIG. 8 is an example of a system 872 for post-print processing consistent with the present disclosure. The system 872 includes a trailing edge clamp 880, a mid-page clamp 879, a leading edge clamp 878, and a corner clamp 877 in an open configuration. The system 872 includes a sheet of print media 874 within the sheet channel 875 above and vertically separated from the stack of printed media 876. The system 872 includes a puller 873 that has pulled the sheet of print media 874 through the sheet channel 875.

Figure 9:
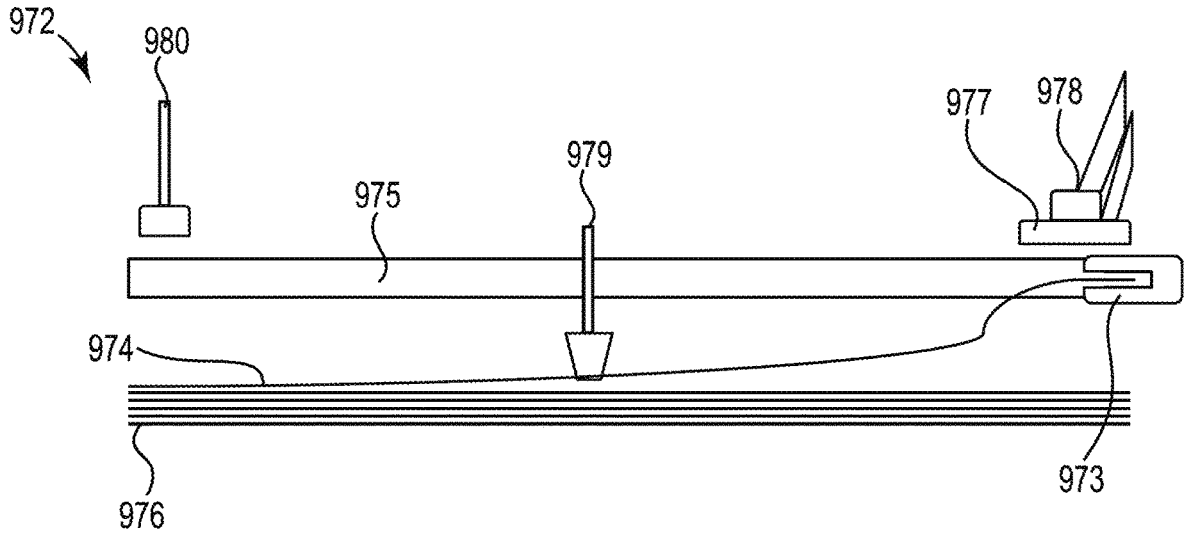
FIG. 9 is another example of a system consistent with the present disclosure.

FIG. 9 is an example of a system 972 for post-print processing consistent with the present disclosure. The system 972 includes a trailing edge clamp 980, a leading edge clamp 978, and a corner clamp 977 in an open configuration. The puller 973 is still gripping the sheet of print media 974 and/or pulling the sheet of print media 974 longitudinally. The sheet channel 975 is illustrated shifted to an outboard position having released the sheet of print media to fall onto the stack 976 except for at its leading edge still held by the puller 973. The mid-page clamp 979 is illustrated descending into a closed configuration pining the middle portion of the sheet of print media 974 to the stack 976.

The mid-page clamp 979 may pin the middle portion of the sheet of print media 974 prior to the puller 973 releasing the leading edge of the sheet of print media 974 against a y-axis registration surface to align the leading edge of the sheet of print media 974 with a leading edge of the stack 976. Pining the middle portion of the sheet of print media 974 prior to stripping the sheet of print media 974 onto a y-axis registration surface may restrain the middle portion of the sheet of print media 974 in order to inhibit spring back which may occur due to buckling of the leading edge of the sheet 974 against the y-axis registration surface. Additionally, pining the middle portion of the sheet 974 before the peripheral portion of the sheet 974 may function to flatten accumulated buckle in the sheet 974 that may result from trapped air or cockle of the sheets in the stack 976.

After the mid-page clamp 979 is closed, the puller 973 may proceed with its longitudinal movement. The puller 973 may pass between stripping fangs stripping the sheet 974 from the puller and releasing it against a y-axis registration surface to align the sheet 974 with the stack 976 as it falls onto the stack 976.

After the mid-page clamp 979 is closed and the leading edge of the sheet 974 is released, the leading edge clamp 978 and the corner clamp 977 may be closed. Closing the leading edge clamp 978 and the corner clamp may pin the leading edge of the sheet of print media 974 and a corner portion of the sheet of print media 974 to the stack 976 subsequent to the close of the mid-page clamp 979. For example, the closed leading edge clamp 978 may secure the registered leading edge of the sheet of print media 974 to the stack 974. The closed corner clamp 977 may secure and restrain any upward curl in the leading edge corners of the sheet of print media 974. Thus, the leading edge corners of the sheet of print media 974 may be prevented from curling above the stack 976 and/or pushing up on the corners of subsequently deposited sheets of print media.

In some examples, a pair of edge clamps extending along the longitudinal edges of the sheet of print media 974 may be closed to pin an edge portion of the sheet of print media 974 to the stack 976 subsequent to the corner clamp 977 pinning the corner portion of the leading edge of the sheet of print media 974. In some examples, the pair of edge clamps may be closed prior to the corner clamp 977 pinning the corner portion of the leading edge of the sheet of print media 974. The edge clamps may further restrict the sheet of print media 974 to the x-axis and y-axis registered position while inhibiting longitudinal edge curl and cockle.

A trailing edge clamp 980 may be closed, pining a trailing edge of the sheet of print media 974 to the stack 976. The trailing edge clamp may be closed subsequent to the edge clamp pining the edge portion of the sheet of print media 974 to the stack 976. Alternatively, the trailing edge clamp may be closed before the plurality of edge clamps and/or before the leading edge clamp 978.

The sheet channel 975 may be returned to a position aligned with an exit of a print path of a printer. The sheet channel 975 may be returned to a width between two opposing sheet channels 975 that will accommodate a width of a next sheet of print media exiting the print path. In some examples, the sheet channel 975 may be returned to a position aligned with an exit of a print path of a printer subsequent to the edge clamps being closed and/or prior to the trailing edge clamp 980 being closed or opened.

The sequence described above with respect to FIGS. 7-9 may be repeated until a print job is finished. That is, the sequence may be repeated for each sheet of print media for a print job as it is printed. Once a final sheet of print media is for a print job is printed and added to the stack 976, additional post-print processing steps such as stapling may be performed.

For example, once a final sheet of print media of a print job is printed and added to the stack 976, the system 972 may include stapling the completed print job stack together. A leading edge clamp 978, a corner clamp 977, a mid-page clamp 979, an edge clamp, and a trailing edge clamp 980 may be closed on the completed print job stack. The mid-page clamp 979 may be opened from the completed print job stack. The leading edge clamp 978 and the corner clamp 977 may be partially opened on the completed print job stack. Partially opening the leading edge clamp 978 and the corner clamp 977 may include opening the leading edge clamp 978 and the corner clamp 977 less than fully such that they still remain obstructing a path of any incoming print sheet media but are no longer applying their full clamping force onto the completed print job stack. Additionally, the sheet channel 975 may be lowered over and in contact with the top of a longitudinal edge portion of the completed print job stack. Subsequently, a lifting wing may be raised to guide the completed print job stack into a stapler opening as the completed print job stack is shifted horizontally over toward the stapler opening.

Figure 10:
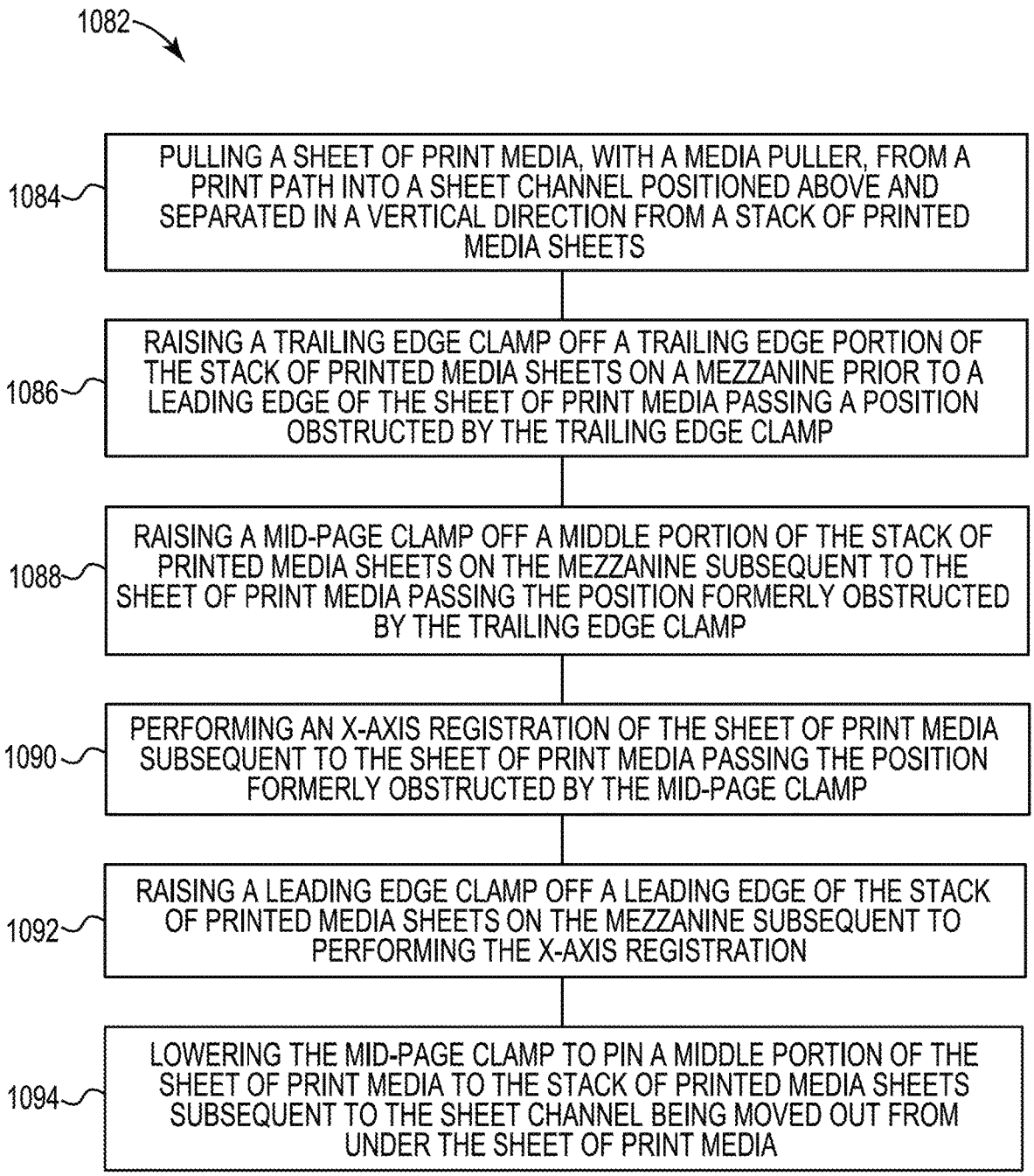
FIG. 10 is an example of a method consistent with the present disclosure.

FIG. 10 is an example of a method 1082 for post-print processing consistent with the present disclosure. At 1084, method 1082 may include pulling a sheet of print media with a media puller. The media puller may clamp onto and pick up a leading edge of the sheet of print media as it exits a print path from a printer. The media puller may pull the sheet of media from the print path into a sheet channel. The sheet channel may be moveable within a body of a print finishing device. However, when the media puller picks up the leading edge of the sheet of media, the sheet channel may be positioned above and separated in a vertical direction from a stack of printed media sheets of a same print job resting on a mezzanine.

At 1086, the method 1082 may include raising a trailing edge clamp that is pining a trailing edge portion of the stack to a mezzanine. The trailing edge clamp may be raised and/or opened prior to a leading edge of the sheet of print media passing a position obstructed by the trailing edge clamp. That is, just before the sheet of print media passes through an area occupied by the trailing edge clamp, the trailing edge clamp is raised out of the path of the incoming sheet of print media.

At 1088, the method 1082 may include raising a mid-page clamp pining a middle portion of the stack to the mezzanine. The mid-page clamp may be raised and/or opened subsequent to the sheet of print media passing the position formerly obstructed by the trailing edge clamp but immediately prior to the leading edge of the sheet of print media passing through the area occupied by the mid-page clamp.

At 1090, the method 1082 may include performing an x-axis registration. The x-axis registration may include a horizontal realignment of the sheet of print media subsequent to the sheet of print media passing the position that was formerly obstructed by the mid-page clamp. The x-axis registration may include a horizontal adjustment to an incoming sheet of print media to align the longitudinal edges with the longitudinal edges of an underlying stack that the sheet of print media is being added to. The x-axis registration may be accomplished by a horizontal adjustment to the sheet channels and/or the media puller conveying the sheet of print media through the sheet channels.

At 1092, the method 1082 may include raising and/or opening a leading edge clamp that is pining a leading edge of the stack of printed sheets to the mezzanine. The leading edge clamp may be raised subsequent to and/or concurrent with performing the x-axis registration.

As described above, raising and/or opening the plurality of clamps sequentially and immediately prior to the passage of the leading edge of the sheet of print media passing the position that was formerly obstructed by each clamp may maintain the alignment of the stack of printed sheets while bringing in the incoming sheet of print media. That is, the release or opening of each clamp from the stack of printed sheets may occur just prior to when the leading edge of an incoming sheet will pass through the location occupied by the clamp. In this manner, the stack of printed sheet is clamped such each clamp position remains clamped retaining stack alignment for as much of the duration of the introduction of an incoming sheet of print media to the stack as can be accommodated without delaying the travel of the sheet of print media through the channels.

At 1094, the method 1082 may include lowering and/or closing the mid-page clamp. The mid-page clamp may be lowered to pin the middle portion of an incoming sheet of print media to the stack. The mid-page clamp may be lowered subsequent to the sheet channel being moved out from under the sheet of print media. That is, the sheet channel that is supporting and guiding the sheet of print media may be moved outboard, releasing the sheet of print media to begin to fall to the stack of printed media. The mid-page clamp may be lowered onto a middle portion of the sheet of print media guiding down and pining the middle portion of the sheet of print media to the underlying stack of printed media sheets. The mid-page clamp may be lowered while the leading edge of the sheet of print media is still supported by a puller.

The method 1082 may also include calibrating an elevation of a plurality of clamps, such as the leading edge clamp, the corner clamps, the mid-page clamps, the edge clamps, and the trailing edge clamps. Calibrating a specific clamp may include calibrating an elevation of the clamp relative to the mezzanine and/or calibrating the overall travel of the specific clamp. In some examples, the mid-page clamp may be calibrated. In some examples the leading edge clamp, the corner clamps, the edge clamps, and the trailing edge clamps may not be calibrated and/or may rely on the calibration measurements determined in calibrating the mid-page clamp for calibrating an elevation of the clamp relative to the mezzanine and/or calibrating the overall travel of the specific clamp.

Calibrating a clamp, such as the mid-page clamp, may include lowering the clamp onto the mezzanine (e.g., closing the clamp) until an actuator lowering the clamp stalls. That is, the actuator may drive the clamp onto the surface of the mezzanine until the actuator that is driving the clamp experiences enough resistive force that it stalls and no longer detects movement by an encoder or other detection system. The amount of torque force that will cause the actuator to stall may be set purposely low compared to the amount of torque force that may damage the components of the actuator, the clamp, and/or the mezzanine.

Additionally, there may be lost motion and/or spring built into the clamp such that when the actuator stalls at a known distance, corresponding to the lost motion and/or spring distance, may be subtracted from a position where the clamp was located when the stall torque force was reached, yielding a pining position for the clamps. The pining position for the clamps may include the amount of travel and/or the elevation of the clamp relative to the mezzanine that is used when the clamp is closed pining an incoming sheet of print media to a stack and/or the mezzanine. The known distance subtracted from the position where the clamp was located when the stall force was reached may be less than a total amount of lost motion and/or spring for the clamp. In such examples, the remaining lost motion and/or spring for the clamp may be utilized to accommodate the added height of each new sheet of print media added to a stack without a recalibration. The pining position may be used in a subsequent lowering or closing of the clamp. For example, the mid-page clamp may be lowered to the pining position when pining the sheet of print media to the mezzanine subsequent to the calibration of the mid-page clamp.

In the foregoing detail description of the present disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that structural changes may be made without departing from the scope of the present disclosure.

The figures herein follow a numbering convention in which the first digit corresponds to the drawing figure number and the remaining digits identify an element or component in the drawing. Elements shown in the various figures herein can be added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense. Further, as used herein, "a number of" an element and/or feature can refer to any number of such elements and/or features.

What is claimed:

1. A device comprising:

a sheet channel to guide a sheet of print media within the sheet channel above and separated in a vertical direction from a stack of printed media when the sheet of print media exits a print path of a printer; and a plurality of clamps to control alignment of the sheet of print media on the stack of printed media when the sheet channel moves outboard from the sheet of print media to allow the sheet of print media to fall onto the stack of printed media, wherein the plurality of clamps sequentially pin each sheet of a plurality of sheets including the sheet of print media to the stack of printed media from a middle portion of the sheet of print media outward.

2. The device of claim 1, wherein the plurality of clamps includes a midpage clamp to pin the middle portion of the sheet of print media to the stack of printed media.

3. The device of claim 2, wherein the plurality of clamps includes:

a leading edge clamp to pin a registered leading edge of the sheet of print media to the stack of printed media subsequent to the mid-page clamp pinning the middle portion of the sheet of print media to the stack of printed media; and a corner clamp to clamp a corner of the leading edge of the sheet of print media subsequent to the mid-page clamp pinning the middle portion of the sheet of print media to the stack of printed media.

4. The device of claim 3, wherein the corner clamp is driven by a servomechanism separate from a mechanism driving the leading edge clamp.

5. The device of claim 3, wherein the corner clamp is mechanically linked to the leading edge clamp such that a pinning action of the leading edge clamp drives a pinning action of the corner clamp.

6. The device of claim 1, wherein the plurality of clamps includes an edge clamp to pin an edge portion of the sheet of print media to the stack of printed media subsequent to a corner clamp pinning the corner of the leading edge of the sheet of print media.

7. The device of claim 6, wherein the plurality of clamps includes a trailing edge clamp to pin a trailing edge portion of the sheet of print media to the stack of printed media subsequent to the edge clamp pining the edge portion of the sheet of print media to the stack of printed media.

8. A system comprising:

a media puller to pull a sheet of print media within a sheet channel positioned above and separated vertically from a stack of printed media of a same print job;

a mid-page clamp closable to pin a middle portion of the sheet of print media to the stack of printed media subsequent to the sheet channel moving outboard to release the sheet of print media and prior to the media puller releasing a leading edge of the sheet of print media against a y-axis registration surface to align the leading edge of the sheet of print media with a leading edge of the stack of printed media;

a leading edge clamp and a corner clamp closable to pin the leading edge of the sheet of print media and a corner portion of the sheet of print media to the stack of printed media subsequent to the close of the mid-page clamp; and a trailing edge clamp closable to pin a trailing edge of the sheet of print media to the stack of printed media subsequent to the close of the mid-page clamp.

9. The system of claim 8, comprising a sensor to:

sense a position of the sheet of print media within the channel; and trigger an x-axis registration of the sheet of print media prior to the leading edge of the sheet of print media reaching the leading edge clamp.

10. The system of claim 8, wherein the trailing edge clamp and the midpage clamp are opened subsequent to a closure of the mid-page clamp, a closure of the leading edge clamp, a closure of the corner clamp, and a closure of the trailing edge clamp.

11. The system of claim 10, wherein the leading edge clamp and the corner clamp are partially opened subsequent to the closure of the mid-page clamp, the closure of the leading edge clamp, the closure of the corner clamp, and the closure of the trailing edge clamp.

12. The system of claim 11, wherein the sheet channel is lowered over a top of an edge portion of the stack of printed media including the sheet of print media.

13. The system of claim 11, comprising a lifting wing to raise and guide the stack of printed media, including the sheet of print media, into an opening of a stapler device when the stack of printed media, including the sheet of print media, is shifted into the opening.

14. A method of print media alignment comprising:

pulling a sheet of print media, with a media puller, from a print path into a sheet channel positioned above and separated in a vertical direction from a stack of printed media sheets;

raising a trailing edge clamp off a trailing edge portion of the stack of printed media sheets on a mezzanine prior to a leading edge of the sheet of print media passing a position obstructed by the trailing edge clamp;

raising a mid-page clamp off a middle portion of the stack of printed media sheets on the mezzanine subsequent to the sheet of print media passing the position formerly obstructed by the trailing edge clamp;

performing an x-axis registration of the sheet of print media subsequent to the sheet of print media passing the position formerly obstructed by the mid-page clamp;

raising a leading edge clamp off a leading edge of the stack of printed media sheets on the mezzanine subsequent to performing the x-axis registration; and lowering the mid-page clamp to pin a middle portion of the sheet of print media to the stack of printed media sheets subsequent to the sheet channel being moved out from under the sheet of print media.

15. The method of claim 14, comprising lowering the mid-page clamp onto a surface of the mezzanine until an actuator lowering the mid-page clamp stalls.

16. The method of claim 15, comprising:

identifying a pining position of the mid-page clamp by subtracting a known distance from a position of the mid-page clamp when the actuator lowering the mid-page clamp stalled; and lowering the mid-page clamp to the pinning position when pinning the sheet of print media to the mezzanine.

* * * * *